US011139095B2

(12) United States Patent
Okada et al.

(10) Patent No.: US 11,139,095 B2
(45) Date of Patent: Oct. 5, 2021

(54) MULTILAYER COIL COMPONENT

(71) Applicant: MURATA MANUFACTURING CO., LTD., Kyoto-fu (JP)

(72) Inventors: Yoshiko Okada, Nagaokakyo (JP); Atsushi Yamamoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 1200 days.

(21) Appl. No.: 15/494,841

(22) Filed: Apr. 24, 2017

(65) Prior Publication Data

US 2017/0229221 A1 Aug. 10, 2017

Related U.S. Application Data

(63) Continuation of application No. PCT/JP2015/081077, filed on Nov. 4, 2015.

(30) Foreign Application Priority Data

Nov. 6, 2014 (JP) ..... JP2014-226303

(51) Int. Cl.

| | |
|---|---|
| ***H01F 1/147*** | (2006.01) |
| ***H01F 1/34*** | (2006.01) |
| ***H01F 27/28*** | (2006.01) |
| ***H01F 17/00*** | (2006.01) |
| ***C22C 38/00*** | (2006.01) |
| ***H01F 27/245*** | (2006.01) |
| ***H01F 27/255*** | (2006.01) |
| *H01F 17/04* | (2006.01) |
| *H01F 27/04* | (2006.01) |

(52) U.S. Cl.

CPC ..... *H01F 1/14733* (2013.01); *C22C 38/00* (2013.01); *H01F 1/344* (2013.01); *H01F 17/0013* (2013.01); *H01F 27/245* (2013.01); *H01F 27/255* (2013.01); *H01F 27/28* (2013.01); *H01F 27/2804* (2013.01); *C22C 2202/02* (2013.01); *H01F 17/04* (2013.01); *H01F 27/04* (2013.01); *H01F 2017/0093* (2013.01); *H01F 2027/2809* (2013.01); *Y10T 428/32* (2015.01)

(58) Field of Classification Search

None

See application file for complete search history.

(56) References Cited

U.S. PATENT DOCUMENTS 6,033,594 A * 3/2000 Enokido ..... C04B 35/265 252/62.58
6,113,843 A * 9/2000 Aoki ..... H01J 29/76 264/613
6,338,900 B1 * 1/2002 Tada ..... H01F 1/37 148/306
6,803,130 B1 * 10/2004 Tomono ..... H01F 1/344 428/692.1
8,138,959 B2 * 3/2012 Itoh ..... H05K 9/0075 342/1
8,237,529 B2 * 8/2012 Tanaka ..... C04B 35/6262 336/105
9,230,722 B2 * 1/2016 Ankyu ..... H01F 1/344
9,296,659 B2 * 3/2016 Nakamura ..... C04B 35/265
2004/0183048 A1 * 9/2004 Kobayashi ..... C04B 35/2658 252/62.59
2012/0326828 A1 * 12/2012 Nakamura ..... B32B 15/20 336/200
2013/0057375 A1 * 3/2013 Ankyu ..... H01F 3/08 336/83
2015/0228395 A1 * 8/2015 Ochiai ..... H01F 1/344 336/221
2016/0185669 A1 * 6/2016 Liu ..... H01F 1/344 264/666

FOREIGN PATENT DOCUMENTS

JP 2001-076923 A 3/2001
JP 2001-118714 A 4/2001
JP 2013-053042 A 3/2013
(Continued)

OTHER PUBLICATIONS

Machine Translation of JP 2015-023275 A. (Year: 2015).*
JPO Abstract Translation of JP 2003-007522 A (Year: 2003).*
International Search Report issued in PCT/JP2015/081077; dated Jan. 26, 2016.
Written Opinion issued in PCT/JP2015/081077; dated Jan. 26, 2016.
International Preliminary Report on Patentability issued in PCT/JP2015/081077; dated May 9, 2017.
An Office Action; "Notice of Reasons for Rejection," issued by the Japanese Patent Office dated Nov. 28, 2017, which corresponds to Japanese Patent Application No. 2016-557780 and is related to U.S. Appl. No. 15/494,841.

*Primary Examiner* — Kevin M Bernatz
(74) *Attorney, Agent, or Firm* — Studebaker & Brackett PC

(57) ABSTRACT

A multilayer coil component including: a magnetic part that contains Fe, Zn, V, and Ni and optionally contains Mn and/or Cu; and a conductor part that contains copper. In the magnetic part, Fe is in an amount of 34.0 to 48.5 mol % expressed as $Fe_2O_3$ equivalent, Zn is in an amount of 6.0 to 45.0 mol % expressed as ZnO equivalent, Mn is in an amount of 0 to 7.5 mol % expressed as $Mn_2O_3$ equivalent, Cu is in an amount of 0 to 5.0 mol % expressed as CuO equivalent, and V is in an amount of 0.5 to 5.0 mol % expressed as $V_2O_5$ equivalent, with respect to the total amount of Fe expressed as $Fe_2O_3$ equivalent, Zn expressed as ZnO equivalent, V expressed as $V_2O_5$ equivalent, and Ni expressed as NiO equivalent, and optionally present Cu expressed as CuO equivalent and optionally present Mn expressed as $Mn_2O_3$ equivalent.

1 Claim, 2 Drawing Sheets

(56) References Cited

FOREIGN PATENT DOCUMENTS

| | | | |
|---|---|---|---|
| JP | 2015-023275 | A | 2/2015 |
| WO | 2014/050867 | A1 | 4/2014 |

* cited by examiner

MULTILAYER COIL COMPONENT

CROSS REFERENCE TO RELATED APPLICATIONS

This application claims benefit of priority to Japanese Patent Application 2014-226303 filed Nov. 6, 2014, and to International Patent Application No. PCT/JP2015/081077 filed Nov. 4, 2015, the entire content of which is incorporated herein by reference.

TECHNICAL FIELD

The present disclosure relates to a multilayer coil component. More specifically, the present disclosure relates to a multilayer coil component which includes a conductor part containing copper as a main constituent.

BACKGROUND

In the case where copper is used as an internal conductor of a multilayer coil component, it is necessary to co-fire the copper conductor and a ferrite material (magnetic material) in a reducing atmosphere in which copper does not become oxidized. However, this causes a problem in that, for example, if the copper conductor and the ferrite material are co-fired under such a condition, the Fe of the ferrite material is reduced from a trivalent to a divalent form and the resistivity of the multilayer coil component decreases. In view of this, a conductor containing silver as a main constituent has generally been used. However, in consideration of the low resistance, lower price than silver, and tolerance to electrochemical migration, it is preferable to use a conductor containing copper as a main constituent.

Japanese Unexamined Patent Application Publication No. 2013-53042 discloses a ferrite ceramic composition containing at least Fe, Mn, Ni, and Zn, in which the molar quantity of Cu expressed as CuO equivalent is 0 to 5 mol % and (x, y) are in the region defined by A(25, 1), B(47, 1), C(47, 7.5), D(45, 7.5), E(45, 10), F(35, 10), G(35, 7.5), and H(25, 7.5), where x represents the molar quantity mol % of Fe expressed as $Fe_2O_3$ equivalent and y represents the molar quantity mol % of Mn expressed as $Mn_2O_3$ equivalent. Japanese Unexamined Patent Application Publication No. 2013-53042 states that, according to a ferrite ceramic composition having such a structure, the oxidation of Cu and the reduction of $Fe_2O_3$ are prevented or reduced even if the composition and a Cu-based material are co-fired and thus resistivity p does not decrease and a desired insulation performance is achieved.

SUMMARY

Technical Problem

The inventors of the present disclosure conducted a study and found that, although the ferrite ceramic composition (multilayer coil component) disclosed in Japanese Unexamined Patent Application Publication No. 2013-53042 has good performance on a laboratory scale even if copper is used as an internal conductor, the ferrite ceramic composition may have a problem in that, if production is scaled up to an industrial scale, variations in resistivity may result and, for example, when outer electrodes are to be plated, the plate grows to reach a magnetic part.

It is an object of the present disclosure to provide a multilayer coil component whose internal conductor may contain copper and whose resistivity does not vary much even when the multilayer coil component is mass-produced on an industrial scale.

Solution to Problem

The inventors of the present disclosure conducted a study on the cause of variations in resistivity described above and made the following finding. In the case where copper is used as an internal conductor, the multilayer body is fired in a low-oxygen atmosphere (specifically, equilibrium oxygen partial pressure of Cu—$Cu_2O$). In this regard, in the case where the multilayer coil component is mass-produced, the oxygen partial pressure in a furnace becomes uneven, resulting in variations in resistivity of the multilayer coil component. If variations occur in resistivity in this way, there may be a problem in that, when the outer electrodes of a multilayer coil component with a small resistivity are to be plated, the plate grows to reach the magnetic part.

It appears that the unevenness of the oxygen partial pressure in the furnace is caused in the following manner. In the case where multilayer coil components are to be mass-produced, a large furnace is needed to fire multilayer bodies because of the scale of production. In the case where a large furnace is used, it is difficult to achieve a uniform atmosphere in the furnace, and unevenness may occur in oxygen partial pressure in the furnace because of, for example, the effects of an exhaust gas. Furthermore, in the production of the multilayer coil component, an organic binder in the multilayer body is removed by heating at a temperature of 300 to 400° C. to burn before the multilayer body is fired. In the case where copper is used as the internal conductor, the organic binder is burned in a low-oxygen atmosphere to prevent oxidation of copper. Therefore, the organic binder may not be burned completely and may remain in the multilayer body. The remaining organic binder burns in the furnace and uses oxygen, and this may locally form an area in which the oxygen partial pressure is low. In the area in which the oxygen partial pressure is lower than intended, iron in the magnetic material is reduced and resistivity decreases.

The inventors of the present disclosure studied hard to solve the above problem and found that, by employing a magnetic material containing vanadium and by controlling the amounts of other constituents such as iron, zinc, manganese, and copper, it is possible to reduce undesired spreading of plating, even in the case where the multilayer coil component is mass-produced and the furnace has an area in which the oxygen partial pressure is low. On the basis of this finding, the inventors accomplished the present disclosure.

According to an aspect of the present disclosure, there is provided a multilayer coil component including: a magnetic part that contains Fe, Zn, V, and Ni and optionally contains Mn and/or Cu; and a conductor part that contains copper and that is in the form of a coil, wherein, in the magnetic part, Fe is contained in an amount of 34.0 to 48.5 mol % expressed as $Fe_2O_3$ equivalent, Zn is contained in an amount of 6.0 to 45.0 mol % expressed as ZnO equivalent, Mn is contained in an amount of 0 to 7.5 mol % expressed as $Mn_2O_3$ equivalent, Cu is contained in an amount of 0 to 5.0 mol % expressed as CuO equivalent, and V is contained in an amount of 0.5 to 5.0 mol % expressed as $V_2O_5$ equivalent, with respect to the total amount of Fe expressed as $Fe_2O_3$ equivalent, Zn expressed as ZnO equivalent, V expressed as $V_2O_5$ equivalent, and Ni expressed as NiO equivalent, and optionally present Cu expressed as CuO equivalent and optionally present Mn expressed as $Mn_2O_3$ equivalent.

Advantageous Effects of Invention

According to the present disclosure, since the magnetic part contains Fe in an amount of 34.0 to 48.5 mol % expressed as $Fe_2O_3$ equivalent, Zn in an amount of 6.0 to 45.0 mol % expressed as ZnO equivalent, Mn in an amount of 0 to 7.5 mol % expressed as $Mn_2O_3$ equivalent, Cu in an amount of 0 to 5.0 mol % expressed as CuO equivalent, and V in an amount of 0.5 to 5.0 mol % expressed as $V_2O_5$ equivalent, the present disclosure provides a mass-producible multilayer coil component in which undesired spreading of plating does not often occur, even when the multilayer coil component includes a copper-containing internal conductor and is mass-produced.

DETAILED DESCRIPTION

Figure 1:
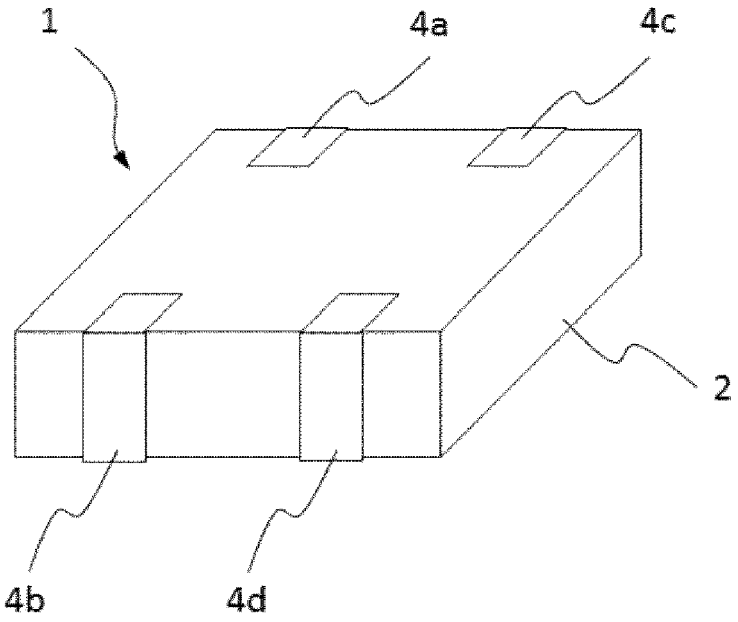
FIG. 1 is a perspective view schematically illustrating a common mode choke coil of one embodiment of the present disclosure.

The following specifically describes a multilayer coil component of the present disclosure (in the present embodiment, the multilayer coil component is a common mode choke coil) and a method of producing the multilayer coil component with reference to the drawings. It should be noted, however, that the structure, shape, number of turns, relative positions, and the like of the multilayer coil component of the present disclosure are not limited to the examples illustrated in the drawings.

Figure 2:
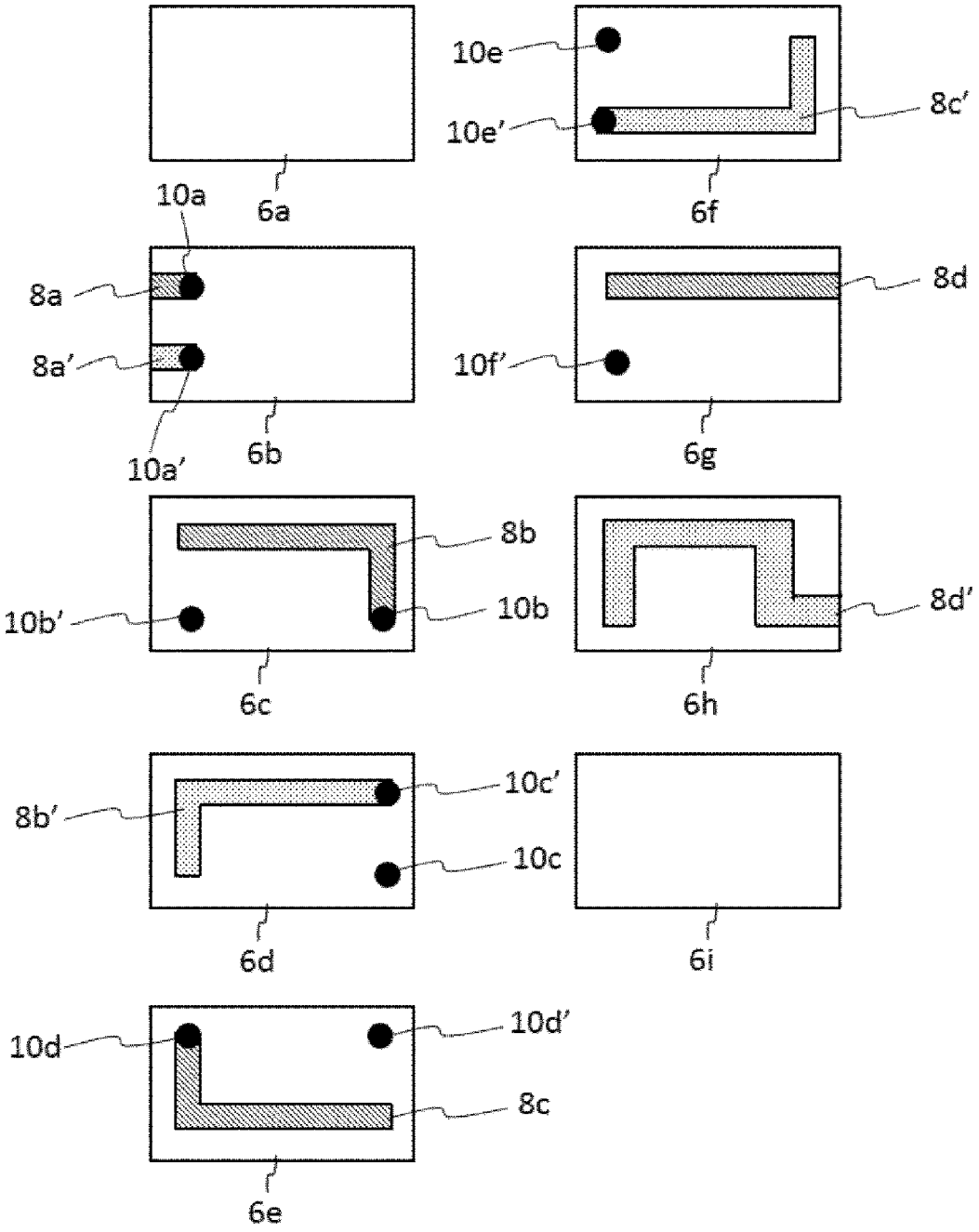
FIG. 2 is an exploded plan view schematically illustrating the common mode choke coil of the embodiment in FIG. 1, except for outer electrodes.

As illustrated in FIGS. 1 and 2, schematically speaking, a common mode choke coil 1 of the present embodiment includes a multilayer body 2 that includes: a magnetic part; and two conductor parts in the form of coils buried in the magnetic part. The common mode choke coil 1 has outer electrodes 4*a*, 4*b*, 4*c*, and 4*d* disposed on the outer surface of the multilayer body 2.

More specifically, as illustrated in FIG. 2, the magnetic part is constituted by a stack of magnetic layers 6*a* to 6*i*. The conductor parts are structured such that conductor layers 8*a* to 8*d* on the magnetic layers are connected together to form a coil through via holes 10*a* to 10*e* passing through the magnetic layers and conductor layers 8*a*' to 8*d*' on the magnetic layers are connected together to form a coil through via holes 10*a*' to 10*f*' passing through the magnetic layers.

The magnetic part is formed of a sintered ferrite containing Fe, Zn, V, and Ni, and, if needed, Mn and/or Cu.

The conductor parts are not limited, provided that the conductor parts are formed of a conducting material containing copper. It is preferable that the conductor parts be formed of a conducting material containing copper as a main constituent. It should be noted that the term "main constituent of the conductor parts" denotes the constituent contained in the conductor parts in the largest amount. For example, the main constituent may be a constituent in an amount of 50 mass % or more, preferably 80 mass % or more, more preferably 90 mass % or more, for example, 95 mass % or more, 98 mass % or more, or 99 mass % or more with respect to the total amount of the conductor parts. In a preferred aspect, the conducting material constituting the conductor parts is substantially composed of copper.

The outer electrodes 4*a* to 4*d* are not particularly limited, but usually formed of a conducting material containing copper or silver as a main constituent and may be plated with, for example, nickel and/or tin.

The common mode choke coil 1 of the present embodiment described above is produced in the following manner.

First, a ferrite material containing Fe, Zn, Ni, and V and optionally containing Mn and/or Cu if needed is prepared.

The ferrite material contains Fe, Zn, Ni, and V as main constituents and may contain other main constituents such as Mn and/or Cu depending on need. The ferrite material may further contain additives. Usually, the ferrite material may be prepared by mixing desired proportions of powders of $Fe_2O_3$, ZnO, NiO, $V_2O_5$, $Mn_2O_3$, and CuO as raw materials for the main constituents and calcining the mixture. However, this does not imply any limitation.

The amount of Fe (expressed as $Fe_2O_3$ equivalent) of the ferrite material is 34.0 to 48.5 mol % (with respect to the total amount of the main constituents). Since the amount of Fe (expressed as $Fe_2O_3$ equivalent) is 48.5 mol % or less, it is possible to prevent or reduce the reduction of Fe from a trivalent to a divalent form and prevent or reduce a decrease in resistivity. Furthermore, the amount of Fe (expressed as $Fe_2O_3$ equivalent) is preferably 34.0 mol % or more, because, when the amount of Fe (expressed as $Fe_2O_3$ equivalent) is less than 34.0 mol %, this leads to a decrease in resistivity instead of preventing or reducing a decrease in resistivity, and an insulation property is not obtained.

The amount of Zn (expressed as ZnO equivalent) in the ferrite material is 6.0 to 45.0 mol % (with respect to the total amount of the main constituents). Since the amount of Zn (expressed as ZnO equivalent) is 6.0 mol % or more, it is possible to achieve high magnetic permeability and obtain a large inductance. Furthermore, since the amount of Zn (expressed as ZnO equivalent) is 45.0 mol % or less, it is possible to avoid lowering of the Curie point and avoid lowering of operating temperature of the multilayer coil component.

The amount of V (expressed as $V_2O_5$ equivalent) of the ferrite material is 0.5 to 5.0 mol % (with respect to the total amount of the main constituents). By firing the multilayer body containing 0.5 to 5.0 mol % of V (expressed as $V_2O_5$ equivalent), it is possible to improve resistivity and also possible to reduce variations in resistivity from one coil component to another.

In the present disclosure, the ferrite material may further contain Cu. The amount of Cu (expressed as CuO equivalent) in the ferrite material is 0 to 5.0 mol % (with respect to the total amount of the main constituents). It should be noted that Cu is not essential and that the amount of Cu may be 0. According to one aspect, the amount of Cu (expressed as CuO equivalent) of the ferrite material is 0.1 to 5.0 mol %. By firing a multilayer body containing Cu, it is possible to improve DC superimposition characteristics.

In the present disclosure, the ferrite material may further contain Mn. The amount of Mn (expressed as $Mn_2O_3$ equivalent) of the ferrite material is 0 to 7.5 mol % (with respect to the total amount of the main constituents). It should be noted that Mn is not essential and that the amount of Mn may be 0. According to one aspect, the amount of Mn (expressed as $Mn_2O_3$ equivalent) of the ferrite material is 0.1 to 7.5 mol %. Mn in the ferrite material reduces the magnetic coercive force of the magnetic material and increases magnetic flux density, and therefore, magnetic permeability improves. In addition, since Mn is reduced before Fe is reduced, it is possible to avoid a decrease in resistivity caused by the reduction of Fe.

The amount of Ni (expressed as NiO equivalent) of the ferrite material is not particularly limited. The ferrite material may contain the above-described other main constituents Fe, Zn, V, Cu, and Mn with the balance being Ni.

An example of an additive in the ferrite material is Bi, but the additive is not limited to Bi. The amount (additive amount) of Bi expressed as $Bi_2O_3$ equivalent is preferably 0.1 to 1 part by weight per 100 parts by weight of the total of the main constituents (Fe (expressed as $Fe_2O_3$ equivalent), Zn (expressed as ZnO equivalent), V (expressed as $V_2O_5$ equivalent), Cu (expressed as CuO equivalent), Mn (expressed as $Mn_2O_3$ equivalent), and Ni (expressed as NiO equivalent)). When the amount of Bi (expressed as $Bi_2O_3$ equivalent) is 0.1 to 1 part by weight, low-temperature firing is further accelerated and abnormal grain growth is avoided. Too much Bi (expressed as $Bi_2O_3$ equivalent) is not preferable because abnormal grain growth is likely to occur, the resistivity in the area of the abnormal grain growth decreases, and, when outer electrodes are formed and plated, the plate adheres to the area of the abnormal grain growth.

It should be noted that the constituents of the unsintered ferrite material, e.g., CuO and $Fe_2O_3$, may be partially changed to $Cu_2O$ and $Fe_3O_4$, respectively, after sintering by firing the magnetic part. However, it can safely be said that the amounts of the main constituents, for example, expressed as CuO equivalent and $Fe_2O_3$ equivalent, of the sintered magnetic part are substantially the same as the amounts of the main constituents CuO and $Fe_2O_3$ in the unsintered ferrite material, respectively.

A magnetic sheet is prepared from the above-described ferrite material. For example, the magnetic sheet may be obtained by mixing and kneading the ferrite material with an organic vehicle containing a binder resin and an organic solvent and forming the mixture into a sheet. However, this does not imply any limitation.

A conductive paste containing copper is prepared separately. A commercially available typical copper paste containing copper powder may be used, but the conductive paste is not limited to such. The average particle size D50 (particle size equivalent to the 50th percentile of the cumulative percentage by volume found by a laser diffraction scattering method) of the copper powder in the conductive paste is preferably 0.5 to 10 μm, more preferably 0.5 to 5 μm. The average particle size D50 of the copper powder within this range helps diffusion of copper from the internal conductor to the magnetic material, achieves a preferred condition, and makes it possible to achieve a predetermined Cu percentage in a specific region of the magnetic material.

Next, the magnetic sheets (corresponding to magnetic layers 6*a* to 6*i*) thus obtained are stacked together with copper-containing conductive paste layers (corresponding to conductor layers 8*a* to 8*d* and 8*a*' to 8*d*') therebetween to obtain a multilayer body (which has not been fired at this point and which corresponds to a multilayer body 2) in which the conductive paste layers are connected together to form coils through via holes (corresponding to via holes 10*a* to 10*e* and 10*a*' to 10*f*') passing through the magnetic sheets.

A method of forming the multilayer body is not particularly limited. The multilayer body may be formed by a sheet lamination process, a printing lamination process, or the like. In the case of the sheet lamination process, a multilayer body may be obtained by: making via holes as needed in the magnetic sheets; forming conductive paste layers by applying the conductive paste in a predetermined pattern (in the case where there are via holes, the via holes are also filled); stacking and pressing the magnetic sheets having the conductive paste layers formed thereon as needed; and cutting the stack into a predetermined size. In the case of the printing lamination process, a multilayer body may be obtained by: making the magnetic ferrite material in the form of a paste; and forming a magnetic paste layer and a conductive paste layer by applying the magnetic ferrite paste and the conductive paste in a predetermined order on a base board such as a PED (polyethylene terephthalate) film by printing and repeating this process as needed; and then cutting the sheets into a predetermined size. The multilayer body may be obtained by: forming a plurality of multilayer bodies in a matrix manner at a single time and thereafter cutting into individual pieces with a dicing machine or the like (device isolation). Alternatively, the multilayer bodies may be produced one by one.

Next, the magnetic sheets and the conductive paste layers containing copper are fired by treating the obtained unfired multilayer body with heat at a predetermined oxygen partial pressure to give the magnetic layers 6*a* to 6*i* and conductor layers 8*a* to 8*d* and 8*a*' to 8*d*', respectively. In the multilayer body 2 thus obtained, the magnetic layers 6*a* to 6*i* constitute a magnetic part, the conductor layers 8*a* to 8*d* constitute one conductor part in the form of a coil, and the conductor layers 8*a*' to 8*d*' constitute another conductor part in the form of a coil.

The oxygen partial pressure for the firing is preferably equal to or less than the equilibrium oxygen partial pressure of Cu—$Cu_2O$ (reducing atmosphere) and more preferably to the equilibrium oxygen partial pressure of Cu—$Cu_2O$. By treating the unfired multilayer body with heat at such an oxygen partial pressure, it is possible to avoid the oxidation of Cu in the conductor parts. Furthermore, the unfired multilayer body may be sintered at a lower temperature than that for heat treatment in air and the firing temperature may be, for example, 950 to 1100° C. Although the present disclosure is not limited by any theory, it is apparent that, in the case where the unfired multilayer body is fired in an atmosphere with a low oxygen concentration, oxygen defects are formed in the crystal structure, and interdiffusion between Fe, Zn, V, Cu, Mn, and Ni is accelerated through the oxygen defects, and this increases the low-temperature sintering property.

Next, outer electrodes 4*a* to 4*d* are formed on the side faces of the obtained multilayer body 2. The outer electrodes 4*a* to 4*d* may be formed by, for example: applying a paste containing copper or silver powder and glass or the like to a predetermined region; and treating the obtained structure with heat in an atmosphere in which copper does not become oxidized, for example, at 700 to 850° C., to bake the copper or silver.

In this way, the common mode choke coil 1 of the present embodiment is produced.

The multilayer coil component of the present disclosure has improved resistivity compared with a known multilayer coil component that contains no vanadium and, in addition, is not affected as much by unevenness of oxygen partial pressure that may occur during mass production and thus the variations in resistivity may be reduced. Although the present disclosure is not limited by any theory, it is apparent that the addition of vanadium to the magnetic part improves resistivity and reduces variations in resistivity for the following reason. A decrease in resistivity seems to occur because Fe is reduced from a trivalent to a divalent form and because hopping conduction occurs between B sites. It is apparent that, if V ($V_2O_5$) is present in this situation, V is reduced from a pentavalent to a tetravalent or a trivalent form and such V enters the B site, and thereby the hopping conduction is prevented or reduced and resistivity is improved.

The resistivity (log p) of the magnetic part of the multilayer coil component of the present disclosure may preferably be 7 Ωcm or more.

According to a preferred aspect, the magnetic part and conductor parts of the multilayer coil component of the present disclosure are co-fired at an equilibrium oxygen partial pressure of Cu—$Cu_2O$ (reducing atmosphere) or less. Since firing is performed at an equilibrium oxygen partial pressure equal to that of Cu—$Cu_2O$ or less, the oxidation of copper in the conductor parts is prevented. Furthermore, since the magnetic part has a specific composition like that described earlier, the magnetic part maintains a high resistivity even in the case where the magnetic part and the conductor parts are co-fired in a reducing atmosphere.

The above description discussed one embodiment of the present disclosure. However, the present disclosure is not limited to this embodiment and may be modified in various forms. For example, the multilayer body may partially have a non-magnetic layer to be of an open magnetic circuit type. The non-magnetic layer is not limited, provided that it is disposed across the magnetic path formed by a coil. The non-magnetic layer may be disposed between coils or outside the coils. The non-magnetic layer is not particularly limited and may be a material that has a similar thermal expansion coefficient to the magnetic part, for example, a magnetic material in which Ni has been entirely replaced with Zn. According to such a multilayer coil component of an open magnetic circuit type, it is possible to further improve DC superimposition characteristics.

EXAMPLES

Example 1

Powders of $Fe_2O_3$, ZnO, $V_2O_5$, NiO, $Mn_2O_3$, and CuO were weighed so that the percentages of the powders were as shown in sample numbers 1 to 29 in Table 1. It should be noted that sample numbers 2 to 5, sample numbers 9 to 14, sample numbers 17 to 22, and sample numbers 24 to 30 are Examples of the present disclosure, whereas sample number 1, sample numbers 6 to 8, sample numbers 15, 16, 23, and 31 (marked with the "*" symbol in Table 1) are Comparative Examples.

TABLE 1

| Sample | Composition of magnetic ferrite (mol %) | | | | | |
|---|---|---|---|---|---|---|
| No. | $Fe_2O_3$ | $Mn_2O_3$ | $V_2O_5$ | ZnO | CuO | NiO |
| *1 | 44.0 | 5.0 | 0.0 | 25.0 | 2.0 | 24.0 |
| 2 | 43.5 | 5.0 | 0.5 | 25.0 | 2.0 | 24.0 |
| 3 | 43.0 | 5.0 | 1.0 | 25.0 | 2.0 | 24.0 |
| 4 | 41.0 | 5.0 | 3.0 | 25.0 | 2.0 | 24.0 |
| 5 | 39.0 | 5.0 | 5.0 | 25.0 | 2.0 | 24.0 |
| *6 | 38.0 | 5.0 | 6.0 | 25.0 | 2.0 | 24.0 |
| *7 | 34.0 | 5.0 | 10.0 | 25.0 | 2.0 | 24.0 |
| *8 | 49.0 | 0.0 | 0.0 | 25.0 | 2.0 | 24.0 |
| 9 | 48.5 | 0.0 | 0.5 | 25.0 | 2.0 | 24.0 |
| 10 | 48.0 | 0.0 | 1.0 | 25.0 | 2.0 | 24.0 |
| 11 | 47.9 | 0.1 | 1.0 | 25.0 | 2.0 | 24.0 |
| 12 | 47.0 | 1.0 | 1.0 | 25.0 | 2.0 | 24.0 |
| 13 | 45.5 | 2.5 | 1.0 | 25.0 | 2.0 | 24.0 |

TABLE 1-continued

| Sample | Composition of magnetic ferrite (mol %) | | | | | |
|---|---|---|---|---|---|---|
| No. | $Fe_2O_3$ | $Mn_2O_3$ | $V_2O_5$ | ZnO | CuO | NiO |
| 14 | 40.5 | 7.5 | 1.0 | 25.0 | 2.0 | 24.0 |
| *15 | 38.0 | 10.0 | 1.0 | 25.0 | 2.0 | 24.0 |
| *16 | 28.0 | 20.0 | 1.0 | 25.0 | 2.0 | 24.0 |
| 17 | 47.5 | 1.0 | 0.5 | 25.0 | 2.0 | 24.0 |
| 18 | 43.0 | 5.0 | 1.0 | 25.0 | 0.0 | 26.0 |
| 19 | 43.0 | 5.0 | 1.0 | 25.0 | 0.1 | 25.9 |
| 20 | 43.0 | 5.0 | 1.0 | 25.0 | 1.0 | 25.0 |
| 21 | 43.0 | 5.0 | 1.0 | 25.0 | 3.0 | 23.0 |
| 22 | 43.0 | 5.0 | 1.0 | 25.0 | 5.0 | 21.0 |
| *23 | 43.0 | 5.0 | 1.0 | 25.0 | 8.0 | 18.0 |
| 24 | 43.0 | 5.0 | 1.0 | 6.0 | 2.0 | 43.0 |
| 25 | 43.0 | 5.0 | 1.0 | 33.0 | 2.0 | 16.0 |
| 26 | 43.0 | 5.0 | 1.0 | 45.0 | 2.0 | 4.0 |
| 27 | 40.8 | 4.7 | 0.9 | 26.2 | 2.1 | 25.3 |
| 28 | 38.6 | 4.5 | 0.9 | 27.5 | 2.2 | 26.3 |
| 29 | 36.4 | 4.2 | 0.8 | 28.7 | 2.3 | 27.6 |
| 30 | 34.2 | 4.0 | 0.8 | 29.9 | 2.4 | 28.7 |
| *31 | 32.0 | 3.7 | 0.7 | 31.1 | 2.5 | 30.0 |

Next, each of the weighed products corresponding to sample numbers 1 to 31, pure water, and PSZ (partial stabilized zirconia) balls were put in a pot mill made of vinyl chloride and crushed and wet-mixed thoroughly. The crushed product was dried by evaporation and then calcined at a temperature of 750° C. for 2 hours. The calcined powder thus obtained, ethanol (organic solvent), and PSZ balls were again put in a pot mill made of vinyl chloride and crushed and mixed thoroughly, and a polyvinyl butyral-based binder (organic binder) was further added and thoroughly mixed to obtain a ceramic slurry. Next, the ceramic slurry thus obtained was formed into a sheet shape having a thickness of 25 μm by a doctor blade method. A size of 50 mm×mm was punched out of the obtained sheet, such that a magnetic sheet made of the ferrite material was prepared.

Next, the magnetic sheets were stacked together so that the thickness would be 0.5 mm after firing and pressed at a temperature of 60° C. and a pressure of 100 MPa for 1 minute to prepare a pressure-bonded block. A sample in the shape of a ring having an outer diameter of 20 mm and an inner diameter of 12 mm was punched out with a mold from the obtained pressure-bonded block.

These samples were placed in a furnace, heated at 400° C. in nitrogen and thoroughly dewaxed, and next, the oxygen partial pressure was adjusted to an equilibrium oxygen partial pressure of Cu—$Cu_2O$ with the use of a $N_2$—$H_2$—$H_2O$ gas mixture, and the samples were fired at a constant temperature of 1000° C. for 2 to 5 hours.

Example 2

With the use of a laser processing machine, via holes were formed in predetermined positions (the positions illustrated in FIG. 2) of the magnetic sheets prepared in EXAMPLE 1, and thereafter a Cu paste containing Cu powder, varnish, and an organic solvent was applied on the surfaces of ferrite sheets by screen printing and also the Cu paste was filled in the via holes. In this way, a coil pattern was formed.

The ferrite sheets having the coil patterns thus prepared and the ferrite sheets with no coil patterns were stacked together as illustrated in FIG. 2, and pressed at a temperature of 60° C. and a pressure of 100 MPa for 1 minute to obtain a pressure-bonded block. Then, the pressure-bonded block was cut into a predetermined size, such that a ceramic multilayer body was prepared.

The ceramic multilayer bodies thus prepared were placed on a $ZrO_2$ plate measuring 200 mm×200 mm with substantially no spaces, and 50 of such plates were prepared. The ceramic multilayer bodies were heated in a furnace in nitrogen at 400° C. and thoroughly dewaxed. Next, in consideration of unevenness of oxygen partial pressure during mass production, the oxygen partial pressure was adjusted to 0.1 times the equilibrium oxygen partial pressure of Cu—$Cu_2O$ with the use of a $N_2$—$H_2$—$H_2O$ gas mixture and the ceramic multilayer bodies were fired at a constant temperature of 1000° C. for 2 to 5 hours.

Next, a copper paste containing Cu powder, glass frit, varnish, and an organic solvent was applied to predetermined positions of the fired ceramic multilayer body, and baked at 800° C. for 5 minutes in an atmosphere in which copper does not become oxidized. Furthermore, the paste was plated with Ni and Sn in this order by electrolytic plating to obtain outer electrodes. In this way, a multilayer coil component (common mode choke coil) illustrated in FIG. 1 in which coil conductors are buried in a magnetic part was prepared. The multilayer coil component thus prepared had a length of 2.1 mm, a width of 1.2 mm, and a thickness of 1.0 mm.

(Evaluation)

Magnetic Permeability μ

The samples in the shape of a ring prepared in EXAMPLE 1 were measured for magnetic permeability μ at 1 MHz in a magnetic material test fixture (product number 16454A-s) available from Agilent Technologies with the use of an impedance analyzer (product number E4991A) available from Agilent Technologies. The results are shown in Table 2.

Plate Characteristics

For each of the numbered samples prepared in EXAMPLE 2, the surfaces of 100 samples were observed under an optical microscope and the distance from an end of an outer electrode (this end is a starting point) to an end of the plating most spread out from the starting point was measured. When the length of the spread plating was longer than 100 μm, it was evaluated as undesired spreading of plating. The percentage of undesired spreading was calculated. The results are also shown in Table 2.

TABLE 2

| Sample No. | Magnetic permeability μ (-) (equilibrium oxygen partial pressure of Cu-$Cu_2O$) | Percentage of undesired spreading of plating (%) (equilibrium oxygen partial pressure of Cu-$Cu_2O$ × 0.1) |
|---|---|---|
| *1 | 295 | 28 |
| 2 | 273 | 0 |
| 3 | 251 | 0 |
| 4 | 228 | 0 |
| 5 | 200 | 0 |
| *6 | 180 | 22 |
| *7 | 163 | 26 |
| *8 | 336 | 42 |
| 9 | 318 | 1 |
| 10 | 300 | 1 |
| 11 | 284 | 0 |
| 12 | 270 | 0 |
| 13 | 267 | 0 |

TABLE 2-continued

| Sample No. | Magnetic permeability μ (-) (equilibrium oxygen partial pressure of Cu-$Cu_2O$) | Percentage of undesired spreading of plating (%) (equilibrium oxygen partial pressure of Cu-$Cu_2O$ × 0.1) |
|---|---|---|
| 14 | 246 | 0 |
| *15 | 231 | 16 |
| *16 | 205 | 10 |
| 17 | 320 | 0 |
| 18 | 320 | 1 |
| 19 | 316 | 0 |
| 20 | 315 | 0 |
| 21 | 290 | 0 |
| 22 | 275 | 0 |
| *23 | 280 | 8 |
| 24 | 35 | 0 |
| 25 | 530 | 0 |
| 26 | 630 | 0 |
| 27 | 370 | 0 |
| 28 | 330 | 0 |
| 29 | 285 | 0 |
| 30 | 245 | 0 |
| *31 | 200 | 30 |

The results demonstrated that, in the case where the amounts of Fe, Zn, Mn, Cu, and V in a ferrite material are within the ranges of the present disclosure, undesired spreading of plating is reduced or prevented even in the case where the firing is performed at an oxygen partial pressure of 0.1 times the equilibrium oxygen partial pressure of Cu—$Cu_2O$ in consideration of unevenness of oxygen partial pressure during mass production like EXAMPLE 2. It is apparent that this enables stable mass production.

INDUSTRIAL APPLICABILITY

A multilayer coil component obtained by the present disclosure may be widely used for various applications in, for example, various electronic devices.

The invention claimed is:

1. A multilayer coil component comprising:

a magnetic part that contains Fe, Zn, V, Mn, Cu, and Ni; and a conductor part that contains copper and that is in the form of a coil, wherein, in the magnetic part, Fe is contained in an amount of 34.0 to 48.5 mol % expressed as $Fe_2O_3$ equivalent, Zn is contained in an amount of 6.0 to 45.0 mol % expressed as ZnO equivalent, Mn is contained in an amount of 0.1 to 7.5 mol % expressed as $Mn_2O_3$ equivalent, Cu is contained in an amount of 0.1 to 5.0 mol % expressed as CuO equivalent, and V is contained in an amount of 0.5 to 5.0 mol % expressed as $V_2O_5$ equivalent, with respect to a total amount of Fe expressed as $Fe_2O_3$ equivalent, Zn expressed as ZnO equivalent, V expressed as $V_2O_5$ equivalent, and Ni expressed as NiO equivalent, and Cu expressed as CuO equivalent and Mn expressed as $Mn_2O_3$ equivalent.

* * * * *